US010629398B2

(12) United States Patent
Miyasaka et al.

(10) Patent No.: US 10,629,398 B2
(45) Date of Patent: Apr. 21, 2020

(54) SWITCH DEVICE

(71) Applicant: OMRON Corporation, Kyoto-shi, Kyoto (JP)

(72) Inventors: Takeshi Miyasaka, Higashiomi (JP); Kazuaki Morita, Izumo (JP)

(73) Assignee: OMRON Corporation, Kyoto-shi (JP)

( * ) Notice: Subject to any disclaimer, the term of this patent is extended or adjusted under 35 U.S.C. 154(b) by 206 days.

(21) Appl. No.: 15/709,510

(22) Filed: Sep. 20, 2017

(65) Prior Publication Data

US 2018/0005785 A1 Jan. 4, 2018

Related U.S. Application Data

(63) Continuation of application No. PCT/JP2016/059197, filed on Mar. 23, 2016.

(30) Foreign Application Priority Data

Apr. 10, 2015 (JP) ..... 2015-081221

(51) Int. Cl.
*H01H 9/00* (2006.01)
*H01H 36/02* (2006.01)
*H01H 5/06* (2006.01)

(52) U.S. Cl.
CPC ..... *H01H 36/02* (2013.01); *H01H 5/06* (2013.01); *H01H 2221/044* (2013.01); *H01H 2235/01* (2013.01)

(58) Field of Classification Search
CPC ..... H01H 3/503; H01H 3/022; H01H 3/3042; H01H 3/60; H01H 3/7006; H01H 1/20;
(Continued)

(56) References Cited

U.S. PATENT DOCUMENTS 4,112,284 A * 9/1978 Leworthy ..... H01H 13/50 200/341
5,204,039 A * 4/1993 Miyasaka ..... B29C 48/30 264/209.2

(Continued)

FOREIGN PATENT DOCUMENTS

CN 1151602 A 6/1997
CN 1338765 A 3/2002

(Continued)

OTHER PUBLICATIONS

The extended European search report dated Apr. 26, 2018 in a counterpart European Patent application.

(Continued)

*Primary Examiner* — Shawki S Ismail
*Assistant Examiner* — Lisa N Homza
(74) *Attorney, Agent, or Firm* — Metrolex IP Law Group, PLLC

(57) ABSTRACT

A switch device includes an actuation unit, a movable unit, a first base, and a second spring, which is a torsion coil spring that acts between the actuation unit and the movable unit. The movable unit is movable with respect to the base. The second spring applies a force to the actuation unit when the actuation unit is at a third position in a direction that is not parallel to a direction in which the torsion coil spring applies a force to the actuation unit when the actuation unit is at a fourth position.

13 Claims, 9 Drawing Sheets

(58) Field of Classification Search
CPC ..... H01H 1/242; H01H 1/245; H01H 1/50; H01H 1/2025; H01H 13/12; H01H 13/52; H01H 13/525; H01H 13/22; H01H 36/02; H01H 2235/01
USPC ..... 335/205
See application file for complete search history.

(56) References Cited

U.S. PATENT DOCUMENTS

| | | | | |
|---|---|---|---|---|
| 8,832,940 | B2 * | 9/2014 | Sarh | B21J 15/14 269/8 |
| 2002/0020618 | A1 | 2/2002 | Mori et al. | |
| 2004/0256210 | A1 * | 12/2004 | Morita | H01H 3/122 200/344 |
| 2005/0156469 | A1 * | 7/2005 | Nishida | H01H 9/443 310/40 MM |
| 2006/0278011 | A1 * | 12/2006 | Miyasaka | G06F 3/0338 73/753 |
| 2007/0120325 | A1 * | 5/2007 | Miyoshi | H01H 25/008 277/304 |
| 2012/0313738 | A1 * | 12/2012 | Chang | H01H 13/702 335/205 |
| 2014/0210290 | A1 * | 7/2014 | Tsukanaka | H02K 21/14 310/91 |
| 2014/0225687 | A1 * | 8/2014 | Kato | H01H 9/443 335/156 |
| 2014/0241915 | A1 * | 8/2014 | Maruyama | F04D 25/0606 417/410.1 |
| 2014/0251780 | A1 * | 9/2014 | Ishikawa | H01H 23/148 200/561 |
| 2015/0377300 | A1 * | 12/2015 | Sato | F16C 35/02 310/425 |
| 2016/0028291 | A1 | 1/2016 | Tsukanaka et al. | |
| 2017/0133171 | A1 * | 5/2017 | Katsube | H01H 1/2025 |
| 2018/0005776 | A1 * | 1/2018 | Otsuka | H01H 1/5844 |
| 2018/0005785 | A1 * | 1/2018 | Miyasaka | H01H 5/06 |

FOREIGN PATENT DOCUMENTS

| | | | |
|---|---|---|---|
| DE | 2303332 | A1 | 8/1974 |
| EP | 1182673 | A2 | 2/2002 |
| EP | 2151837 | A2 | 2/2010 |
| EP | 2362403 | A1 | 8/2011 |
| JP | 2007-227308 | A | 9/2007 |
| JP | 5679093 | B1 | 3/2015 |
| WO | 2015/037286 | A1 | 3/2015 |

OTHER PUBLICATIONS

The office action dated Jul. 27, 2018 in a counterpart Chinese patent application.
English translation of the International Search Report of PCT/JP2016/059197 dated May 31, 2016.
English translation of Written Opinion of PCT/JP2016/059197 dated May 31, 2016 from the International Searching Authority.

* cited by examiner 50
11
11a
1
12
12a
12e
2
13a
3
15
η1
S
Operational force
Spring restoring force
Move
η2
During operation
First position
Second position
Third position
Fourth position
During returning Third position Fourth position

SWITCH DEVICE

CROSS REFERENCE TO RELATED APPLICATIONS

This application is a continuation application of International Application No. PCT/JP2016/059197, filed on Mar. 23, 2016, which claims priority based on the Article 8 of Patent Cooperation Treaty from prior Japanese Patent Application No. 2015-081221, filed on Apr. 10, 2015, the entire contents of which are incorporated herein by reference.

FIELD

The disclosure relates to a switch device.

BACKGROUND

A switch device switches in accordance with the position of a member that moves in response to an operation. The switch device typically includes a spring to allow the moving member to return to its original position.

A switch device described in Patent Literature 1 includes a compression coil spring for resetting a movable contact, and a plate spring for adjusting an operation load. The plate spring with a particular shape arranged at a particular position can achieve a snap action.

CITATION LIST

Patent Literature

Patent Literature 1: Japanese Unexamined Patent Application Publication No. 2007-227308 (published on Sep. 6, 2007)

SUMMARY

Technical Problem

A switch device incorporating a power generator intends to have more power. The power generator generates power by moving its member in response to an operation. Setting a longer stroke for the member that moves in response to an operation increases the amount of power generation. A switch device incorporating a power generator may thus need a longer stroke set for a member that moves in response to an operation. A switch device including no power generator may also need a longer stroke set for a member that moves in response to an operation.

A compression coil spring or a plate spring used for returning movement can increase the size of the switch device. A smaller compression coil spring or a smaller plate spring cannot achieve an intended lifetime, operation load, and stroke.

One or more aspects are directed to a switch device that is small and has a longer stroke for a member that moves in response to an operation.

Solution to Problem

A switch device according to one or more aspects is switchable in accordance with a position of an actuation unit. The switch device includes the actuation unit, a movable unit, a base, and a torsion coil spring that acts between the actuation unit and the movable unit. The movable unit is movable with respect to the base supporting the movable unit. The actuation unit is movable between a first actuation position and a second actuation position, and when the actuation unit is at the first actuation position, the torsion coil spring applies a force to the actuation unit in a direction that is not parallel to a direction in which the torsion coil spring applies a force to the actuation unit when the actuation unit is at the second actuation position.

Advantageous Effects

One or more embodiments can set a longer stroke for an actuation unit and can reduce the size of a switch device.

DETAILED DESCRIPTION

For ease of explanation, components with the same functions are given the same numerals, and may not be described.

First Embodiment

A switch device according to one or more embodiments includes a power generator, a transmitter, and a return mechanism for an operation unit. The structure of the return mechanism will first be described schematically.

Structure of Return Mechanism 50

Figure 1:
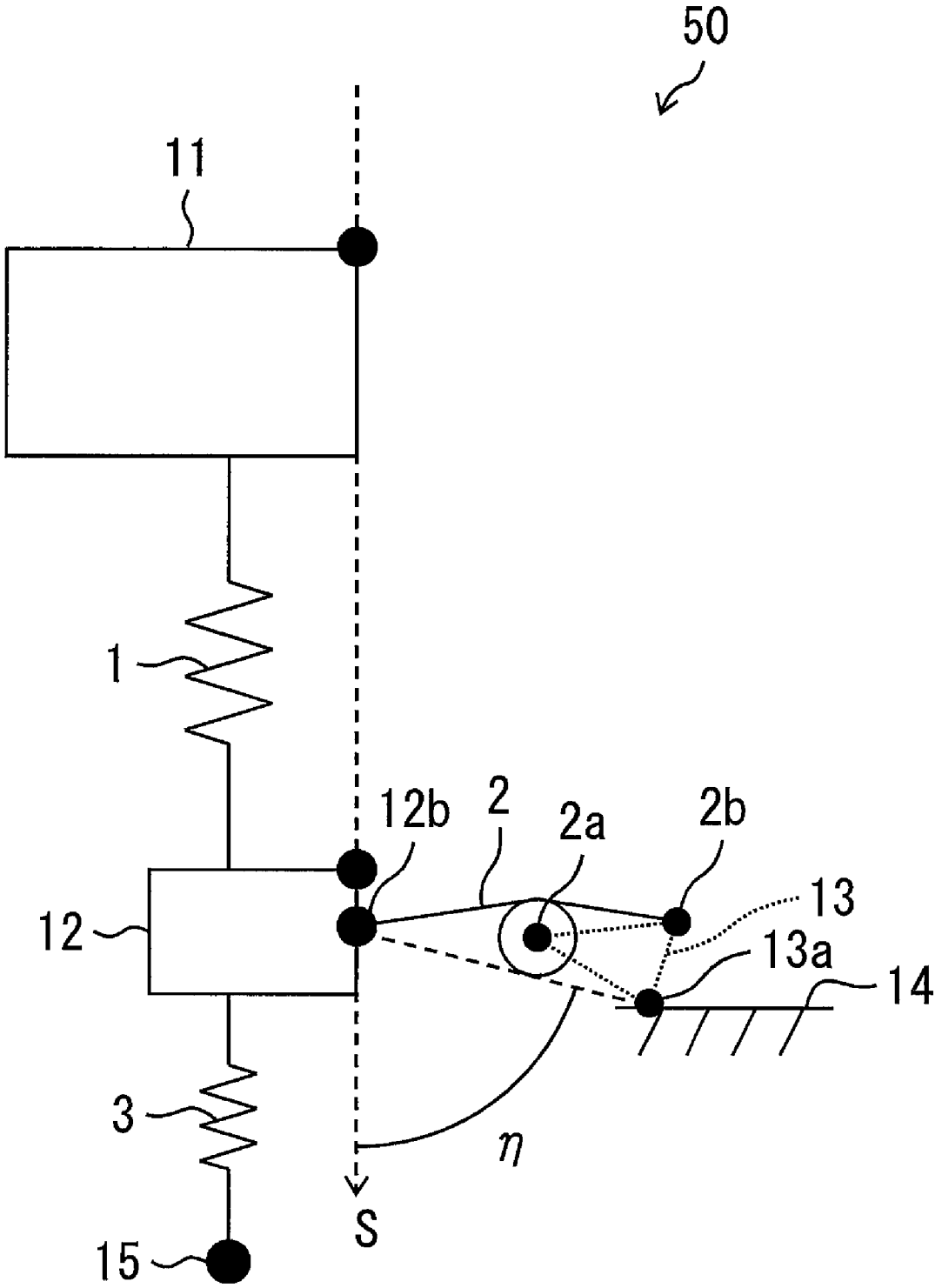
FIG. 1 is a schematic diagram illustrating a return mechanism included in a switch device according to one or more embodiments.

FIG. 1 is a schematic diagram (dynamic model) of a return mechanism 50 according to one or more embodiments. The return mechanism 50 includes an operation unit 11 and an actuation unit 12, which both self-return. The actuation unit 12 moves at high speed independently of the speed at which the actuation unit 12 is operated. A second spring 2 enables the actuation unit 12 to move at high speed. A third spring 3 enables the operation unit 11 and the actuation unit 12 to self-return.

The return mechanism 50 (acceleration mechanism) includes the operation unit 11, the actuation unit 12, a movable unit 13, a first base 14 (base), a second base 15, a first spring 1 (acceleration spring), the second spring 2, and the third spring 3 (return spring). The first spring 1 connects the operation unit 11 and the actuation unit 12. The second spring 2 connects the actuation unit 12 and the movable unit 13. The third spring 3 connects the actuation unit 12 and the second base 15. The first spring 1 and the third spring 3 may be any springs, such as coil springs, torsion coil springs, or plate springs. The second spring 2 is a torsion coil spring having an axis portion 2*a* (coil shaft) and ends 2*b* at one side (arms at one side) fixed to the movable unit 13. The movable unit 13 is supported by the first base 14 and is movable with respect to the first base 14. More specifically, the movable unit 13 is rotatable about an axis portion 13*a*. The first base 14 and the second base 15 are stationary. The first base 14 and the second base 15 may be an integral single component, or may be separate components. The movable unit 13 rotates about the axis portion 13*a* fixed to the first base 14. The axis portion 2*a* and the ends 2*b* of the second spring 2 are fixed to the movable unit 13. The relative positions of the axis portion 2*a* and the ends 2*b* of the second spring 2 and the axis portion 13*a* remain unchanged.

The operation unit 11 and the actuation unit 12 are movable along a stroke axis S. The first spring 1 applies a force to the operation unit 11 in a direction parallel to a direction in which the operation unit 11 is movable. The third spring 3 applies a force to the actuation unit 12 in a direction parallel to a direction in which the actuation unit 12 is movable.

The second spring 2 applies a force to the actuation unit 12 in a direction diagonal to the direction in which the actuation unit 12 is movable. The direction in which the second spring 2 applies a force to the actuation unit 12 and the stroke axis S form an angle $\eta$. The axis portion 13*a* fixed to the first base 14 does not move. The second spring 2 has the other end (arm at the other side) that is connected to the actuation unit 12 and moves as the actuation unit 12 moves. The angle $\eta$ thus changes as the actuation unit 12 moves along the stroke axis S.

The operation unit 11 has an operation point 11*a*, which is used as a reference of displacement of the operation unit 11. When the operation unit 11 translates under an external force, a point on the operation unit 11 also translates. In this translation, the operation point 11*a* may be any point on the operation unit 11. Similarly, the actuation unit 12 has an action point 12*a*, which also translates, used as a reference of displacement of the actuation unit 12.

The operation point 11*a* on the operation unit 11 is displaceable along the stroke axis S between a first position (first operation position) and a second position (second operation position). The action point 12*a* on the actuation unit 12 is displaceable along the stroke axis S between a third position (first actuation position) and a fourth position (second actuation position). The actuation unit 12 is connected to the second spring 2 at a joint 12*b*. The joint 12*b*, at which the actuation unit 12 is connected to the second spring 2, is displaced together with the actuation unit 12 in the same directions as the directions in which the first spring 1 stretches and contracts.

When the action point 12*a* is at the third position, a retaining force acts on the actuation unit 12 to retain the action point 12*a* at the third position. When the action point 12*a* is at the fourth position, a retaining force acts on the actuation unit 12 to retain the action point 12*a* at the fourth position. More specifically, the actuation unit 12 is retained at the third position or the fourth position under a magnetic force acting at that position.

For convenience, the operation point 11*a* being at the first position may be referred to as the operation unit 11 being at the first position. The same applies to the action point 12*a* and the actuation unit 12.

Operation of Return Mechanism 50

FIGS. 2A to 2H are schematic diagrams showing the operation and the returning of the return mechanism 50 according to one or more embodiments. A user applies an operational force as an external force to the operation unit 11 to move the operation unit 11. The actuation unit 12 is displaced as the operation unit 11 is displaced. As the actuation unit 12 moves, the return mechanism 50 functions. For example, a power generator included in the switch device generates power as the actuation unit 12 moves, as described later. The switch device uses the generated power to externally output a signal indicating that the operation unit 11 has been operated.

Figures 2A, 2B, 2C, 2D, 2E, 2F, 2G, 2H:
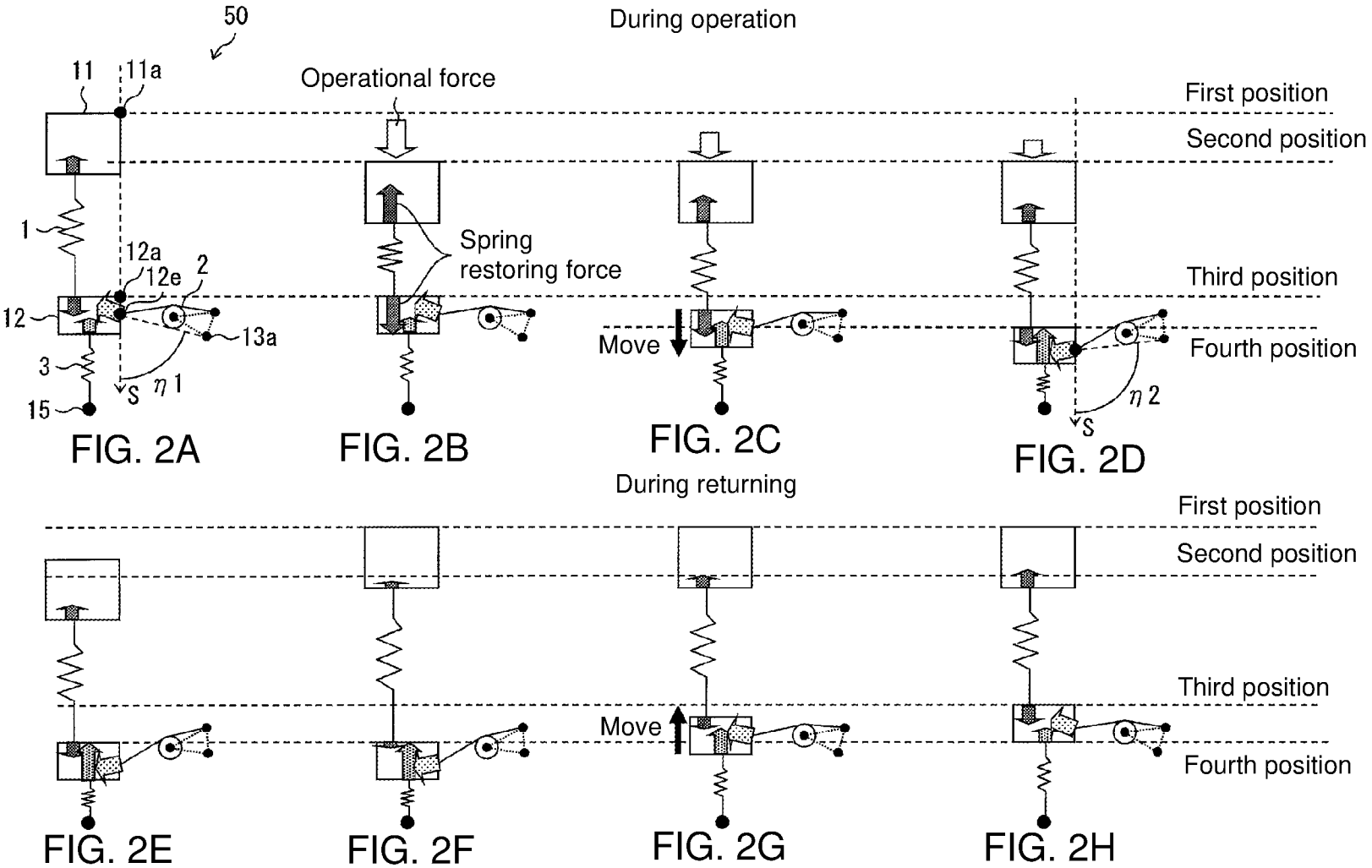
FIGS. 2A to 2H are schematic diagrams illustrating the operation and the returning of a return mechanism.

FIG. 2A shows the initial state of the return mechanism 50. In the figures, spring forces acting on the operation unit 11 and the actuation unit 12 are indicated by arrows, each with the length not exactly showing the magnitude of the force. In the initial state, no external force is applied to the operation unit 11. In the initial state, the actuation unit 12 is retained at the third position under a restoring force of the compressed third spring 3, a restoring force of the deformed second spring 2, and the retaining force (not shown). In the initial state, the operation unit 11 is pressed against the first position under a restoring force of the compressed first spring 1. The actuation unit 12 has an angle $\eta 1$ at the third position. The angle $\eta$ is formed between the direction in which the actuation unit 12 (joint 12*b*) returns and the direction in which the second spring 2 applies its restoring force to the actuation unit 12. When the actuation unit 12 is at the third position, the restoring force of the second spring 2 acting on the actuation unit 12 includes a force component $\cos \eta 1$ along the stroke axis S (component in the direction in which the actuation unit 12 moves). The force acting upward on the actuation unit 12 (force acting in the direction in which the actuation unit 12 returns) is positive.

FIG. 2B shows the operation unit 11 displaced under a force applied for operating the operation unit 11 (operational force). The operational force applied as an external force to the operation unit 11 displaces the operation unit 11 from the first position to the second position. The first spring 1 is compressed as the operation unit 11 is displaced.

When the restoring force of the compressed first spring 1 exceeds the sum of the restoring force of the second spring 2, the restoring force of the third spring 3, and the retaining force, which act on the actuation unit 12, the restoring force of the compressed first spring 1 displaces the actuation unit 12 from the third position to the fourth position (FIG. 2C). The actuation unit 12 displaced to the fourth position is retained at the fourth position under the retaining force (FIG. 2D). As the joint 12*b* on the actuation unit 12 is displaced, the second spring 2 changes its orientation (the second spring 2 rotates) to change the direction of its restoring force. The second spring 2 applies a force to the actuation unit 12 at the third position in a direction that is not parallel to a direction in which the second spring 2 applies a force to the actuation unit 12 at the fourth position.

The actuation unit 12 has an angle $\eta 2$ at the fourth position. When the actuation unit 12 is at the fourth position, the restoring force of the second spring 2 acting on the actuation unit 12 includes a force component $\cos \eta 2$ along the stroke axis S. In this state, $0° < \eta 1 < \eta 2 < 180°$, and $\cos \eta 1 > \cos \eta 2$. In other words, the restoring force of the second spring 2 acting on the actuation unit 12 includes a force component along the stroke axis S (force component having a direction in which the actuation unit 12 returns defined as positive) that is smaller when the actuation unit 12 is at the fourth position than when the actuation unit 12 is at the third position, showing a monotonic decrease. When the actuation unit 12 starts moving from the third position toward the fourth position, the repulsive force of the second spring 2 decreases gradually. The actuation unit 12 starts moving, and then accelerates further. This completes the movement of the operation unit 11 and the actuation unit 12 during operation.

The actuation unit 12 is moved by the first spring 1 when the restoring force of the compressed first spring 1 exceeds the sum of the component of the restoring force of the second spring 2 along the stroke axis S, the restoring force of the third spring 3, and the retaining force, and the accumulated elastic energy is released. In other words, the actuation unit 12 is moved by the first spring 1 at high speed independently of the moving speed of the operation unit 11.

When the operational force on the operation unit 11 is eliminated, the operation unit 11 starts moving from the second position toward the first position under the restoring force of the compressed first spring 1 (FIG. 2E). In this state, the actuation unit 12 is retained at the fourth position under the retaining force and the restoring force of the first spring 1. The restoring force of the first spring 1 gradually decreases as the operation unit 11 is displaced. The operation unit 11 then moves to the first position (FIG. 2F).

When the sum of the restoring force of the compressed first spring 1 and the retaining force decreases below the sum of the component of the restoring force of the second spring 2 acting on the actuation unit 12 along the stroke axis S and the restoring force of the third spring 3, the restoring force of the compressed third spring 3 displaces the actuation unit 12 from the fourth position to the third position (FIG. 2G). The actuation unit 12 moved to the third position is retained under the retaining force (FIG. 2H).

When the actuation unit 12 starts moving from the third position to the fourth position, an upward force of the second spring 2 (force component having a direction in which the actuation unit 12 returns defined as positive) increases gradually. The actuation unit 12 starts moving, and then accelerates further. In this manner, the second spring 2 also moves the actuation unit 12 at high speed when the actuation unit 12 returns. This completes the movement of the operation unit 11 and the actuation unit 12 during returning.

The actuation unit 12 is moved by the third spring 3 when elastic energy accumulated in the third spring 3 is released. In other words, the actuation unit 12 is moved by the third spring 3 at high speed independently of the returning speed of the operation unit 11.

The third spring 3, which causes the actuation unit 12 to return, may be eliminated. For example, the restoring force of the second spring 2 can cause the actuation unit 12 at the fourth position to return to the third position when the restoring force of the second spring 2 includes a force component along the stroke axis S that is upward ($\eta 2<90°$) and is greater than the sum of the retaining force and the restoring force of the first spring 1. When the return spring (third spring 3) is used, the angle $\eta 1$ at the third position may be greater than 90°.

FS Characteristics of Return Mechanism 50

Figure 3:
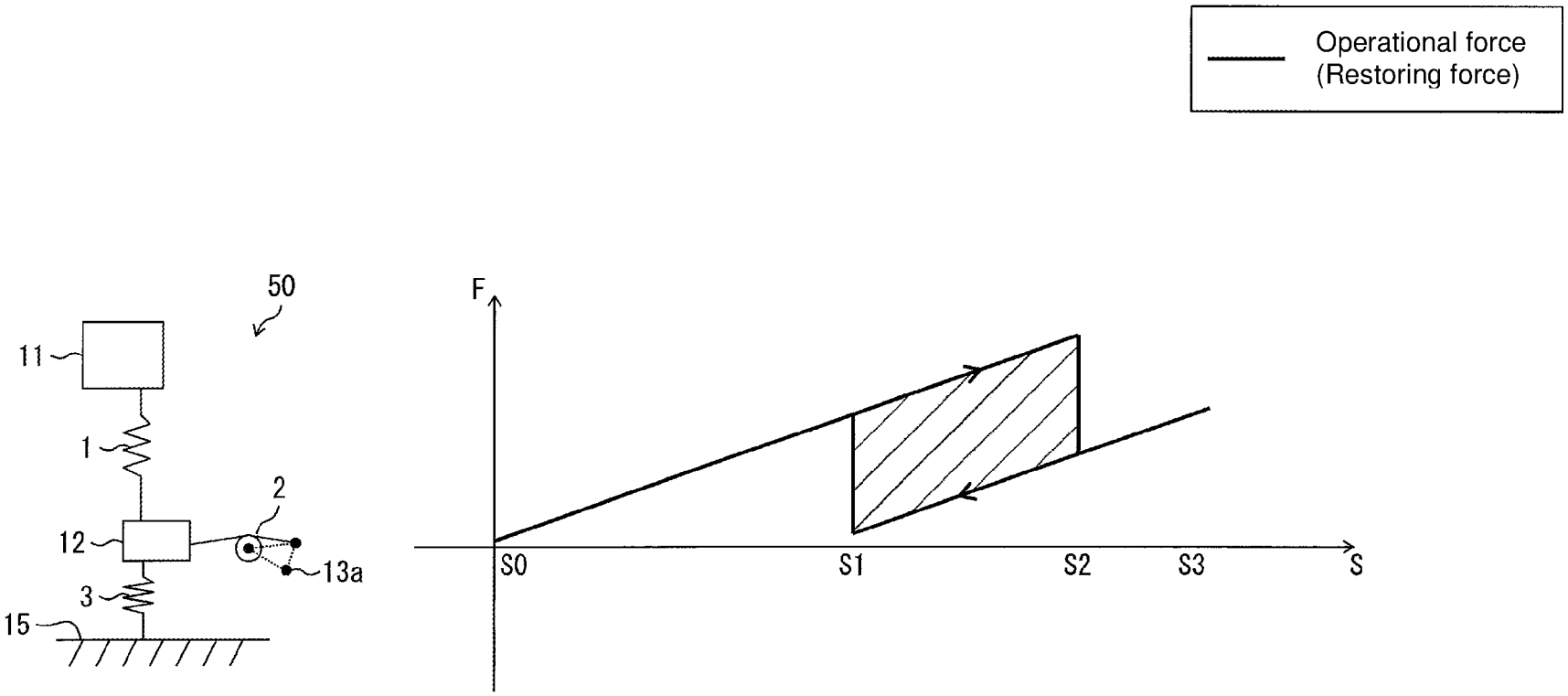
FIG. 3 is a diagram illustrating the structure of a return mechanism and its force-stroke (FS) characteristics.

FIG. 3 is a diagram showing the structure of the return mechanism 50 according to one and its force-stroke (FS) characteristics. The horizontal axis indicates the stroke S of the operation unit 11, and the vertical axis indicates the force F. FIG. 3 shows the operational force. The operational force equal to the repulsive force of the first spring 1 is to be applied at each stroke position. The force being positive refers to the force being upward applied to the operation unit 11 (a direction from the second position to the first position). In other words, the operational force to be applied may be an upward force (return force) that causes the operation unit 11 to return.

The retaining force acting on the actuation unit 12 allows for the hysteresis FS characteristics. The first position of the operation unit 11 may be between a top dead center (S0) of the operation unit 11 and a stroke 51. The second position of the operation unit 11 may be between a stroke S2 and a bottom dead center (S3) of the operation unit 11.

An operational force applied to the operation unit 11 displaces the operation unit 11 from the top dead center (S0). When the operation unit 11 reaches the stroke S2, the restoring force of the compressed first spring 1 exceeds the sum (resultant force) of the retaining force of the actuation unit 12 at the third position, the force of the second spring 2, and the force of the third spring 3. In the stroke S2, the actuation unit 12 is thus displaced from the third position to the fourth position. This displacement frees the compressed first spring 1. The operational force decreases at the same time.

When the operation unit 11 further moves beyond the stroke S2, the first spring 1 is compressed again, and the operational force increases accordingly.

In contrast, when the external force (operational force) applied to the operation unit 11 decreases, the force of the first spring 1 causes the operation unit 11 to return. As the operation unit 11 returns from the second position toward the first position, the first spring 1 is compressed by a lesser degree. When the operation unit 11 reaches the stroke S1, the restoring force of the third spring 3 exceeds the sum of the retaining force of the actuation unit 12 at the fourth position, the force of the second spring 2, and the force of the first spring 1. In the stroke S1, the actuation unit 12 is thus displaced from the fourth position to the third position. This displacement compresses the first spring 1. The return force increases at the same time.

When the operation unit 11 further moves back from the stroke S1, the first spring 1 is compressed by a lesser degree.

The return mechanism 50 includes the second spring 2. This structure uses a larger operational force to be applied to the operation unit 11 to displace the actuation unit 12 from the third position to the fourth position than the structure without the second spring 2. As described above, when the actuation unit 12 is displaced to the fourth position, the force of the second spring 2 includes a smaller force component along the stroke axis S when the direction in which the actuation unit 12 returns from the fourth position to the third position is defined as positive. Setting a greater moving distance (stroke) for the actuation unit 12 causes the first spring 1 to be compressed by a still lesser degree. As a result, the operational force decreases more in the stroke S2. The hatched area in the figure shows the energy applied to the actuation unit 12 during operation and during returning.

The return mechanism 50 according to one or more embodiments can apply greater energy to the actuation unit 12. In other words, the return mechanism 50 can move the actuation unit 12 at high speed. The actuation unit 12 of the return mechanism 50 is combined with a power generator to generate power. This increases the kinetic energy of the actuation unit 12, and thus increases the amount of power generation. This structure can also increase the amount of power generation (allows the actuation unit to move at high speed) without increasing the magnetic force (retaining force) from a magnet included in the power generator.

The return mechanism 50 used in a switch device enables a high-speed switching operation. The return mechanism 50 may be used as a switch device when its actuation unit 12 includes a movable contact for an electrode terminal. When the actuation unit 12 is used as a movable contact for an electrode terminal, the contact can be open quickly. This structure shortens the period in which an arc occurs between the contacts, and can reduce wear.

The second spring 2 may not be connected to the actuation unit 12 and the movable unit 13 in a fixed manner. The second spring 2 may be at least arranged between the actuation unit 12 and the movable unit 13 to apply a repulsive force to these units. Each of the operation unit 11 and the actuation unit 12 may include a plurality of components.

The return mechanism 50 may include the first spring 1 that is stretched during operation and is compressed during returning. For example, the operation unit 11 and the first spring 1 shown in FIG. 1 may be arranged opposite to the actuation unit 12. In this case, the first spring 1 is stretched as the operation unit 11 is displaced downward (toward the second position). The stretched first spring 1 displaces the actuation unit 12 downward (toward the fourth position).

The operation unit 11 and the first spring 1 may be connected using another component, such as a plunger. The first spring 1 (or the second spring 2 or the third spring 3) and the actuation unit 12 may also be connected using another component.

Detailed Structure around Actuation Unit 12

Figure 4:
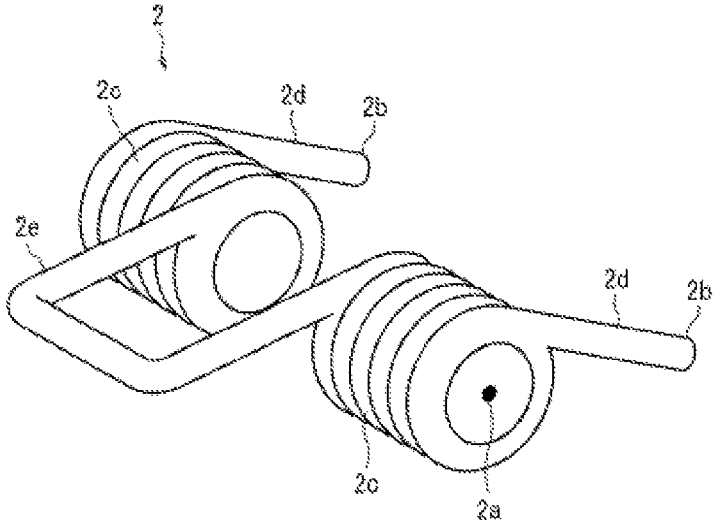
FIG. 4 is a perspective view of a torsion coil spring as a second spring illustrating its detailed structure.

FIG. 4 is a perspective view of a torsion coil spring as the second spring 2 showing its detailed structure. The second spring 2 includes two coil portions 2*c*, two arms 2*d*, and a connecting arm 2*e*. The two coil portions 2*c* have coaxial axis portions 2*a*. The two coil portions 2*c* are connected by the connecting arm 2*e*, which is substantially U-shaped, and extends externally from one of the coil portions 2*c* and bends toward the other coil portion 2*c*. The arms 2*d* extend in the same direction from the opposite sides of the coil portions 2*c*. The coil portions 2*c* are wound in opposite directions. The positions of the two arms 2*d* and the connecting arm 2*e* may be reversed. The connecting arm 2*e* may not be U-shaped but may have any other shape that extends externally from the two coil portions 2*c* and connects the two coil portions 2*c*.

Figure 5:
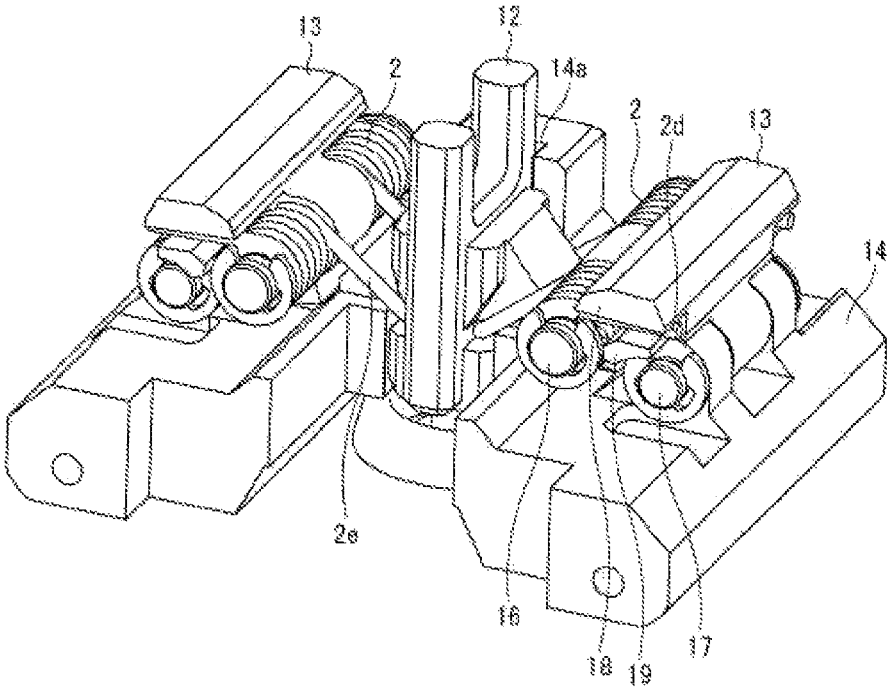
FIG. 5 is a perspective view of a return mechanism illustrating the detailed structure of an actuation unit, movable units, a first base, and second springs.

FIG. 5 is a perspective view of the return mechanism 50 showing the detailed structure of the actuation unit 12, the movable units 13, the first base 14, and the second springs 2. FIG. 5 does not show the operation unit 11, the first spring 1, the third spring 3, and the second base 15.

Two pairs of the second springs 2 and the movable units 13 are arranged symmetric to each other on both sides of the actuation unit 12. The two second springs 2 arranged symmetric to each other on both sides of the actuation unit 12 can cancel components of the restoring forces of the second springs 2 perpendicular to the stroke axis S. This reduces a friction force acting on the actuation unit 12.

A shaft 16 is placed through a hole in each movable unit 13 (axis portion 2*a*) and the coil portions 2*c* of each second spring 2. A shaft 17 is placed through another hole in each movable unit 13 (axis portion 13*a*) and a hole in the first base 14. To prevent the shafts 16 and 17 from slipping off, each of the shafts 16 and 17 has a flange at one end, and an E-ring at the other end. Unlike the structure with, for example, a shaft fitted in a C-shaped (open-end) bearing, the movable units 13 and the first base 14 have the holes with closed ends. This structure prevents the shafts 16 and 17 placed in these holes from being removed under, for example, impact. Further, the shaft 16 placed through the two coil portions 2*c* of each second spring 2 prevents misalignment of the axes of the two coil portions 2*c* under a force applied to the second spring 2. The second springs 2 can allow stable operation and achieve a longer lifetime.

Each movable unit 13 has two ridges (a support 18 and a position regulating ridge 19) on its side surface at one end. Each movable unit 13 further has a support 18 and a position regulating ridge 19 on its side surface at the other end. The arms (ends 2*b*) on one side of each second spring 2 are between the support 18 and the position regulating ridge 19. The support 18 supports the arms on one side of each second spring 2 while receiving a force from the arms. The position regulating ridges 19 are at positions where no force is applied from the arms. The arms, which are placed between the position regulating ridge 19 and the support 18, are prevented from being removed from the movable unit 13 when the switch device receives a large impact. The arms at positions regulated by each position regulating ridge 19 can ease the assembly of the switch device. The connecting arm 2*e* of each second spring 2 is between two ridges on the actuation unit 12. The positions of the connecting arm 2*e* and the arms 2*d* may be reversed.

Each second spring 2 includes the two coil portions 2*c* arranged on both sides of the central connecting arm 2*e*. The two coil portions 2*c* are supported by the shaft 16. The two arms 2*d* extend externally from the two coil portions 2*c*. The two arms 2*d* are supported by the support 18 on each movable unit 13. When receiving a force from the actuation unit 12, the central connecting arm 2*e* supported on its both sides is prevented from being twisted with respect to the axis of the second spring 2. In this manner, the second springs 2 allow the actuation unit 12 to operate in a stable manner. In one or more embodiments, the two second springs 2 are arranged symmetric to each other with respect to the actuation unit 12. In total, the four coil portions 2*c* surround the center of gravity of the actuation unit 12. The two second springs 2 can thus apply forces to the actuation unit 12 in a stable manner. Each connecting arm 2*e* supported by the two coil portions 2*c* on its both sides is less likely to be twisted. The second springs 2 each having the connecting arms 2*e* are appropriately fixed to the movable units 13 that rotate. The two second springs 2 may not be used. A single second spring 2 may be used to move the actuation unit 12.

Although each second spring 2 includes the two coil portions 2*c* connected by the connecting arm 2*e*, the second spring 2 may have another structure. For example, the second spring 2 may include two torsion coil springs that are separate at the center of the connecting arm 2*e*, or may simply be a single torsion coil spring having two arms and a single coil portion.

The first base 14 includes a guide groove 14*a* for guiding the sliding actuation unit 12. The actuation unit 12 partly fits in the guide groove 14*a*. This structure prevents the actuation unit 12 from being twisted.

Detailed Movement of Actuation Unit 12

Figure 6A:
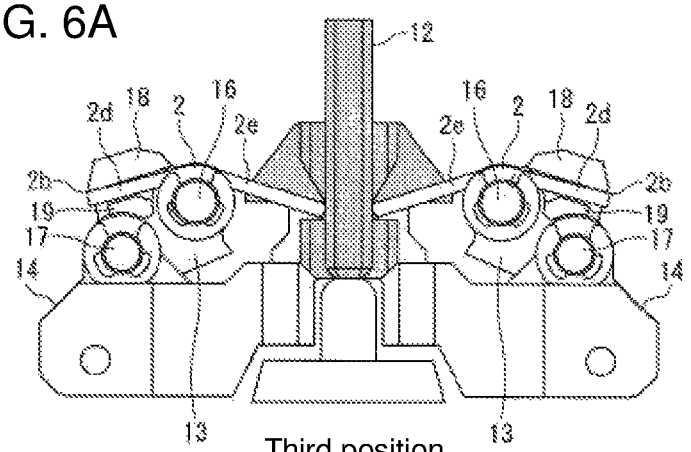
FIGS. 6A to 6C are front views of an actuation unit illustrating its movement.
Figure 6B:
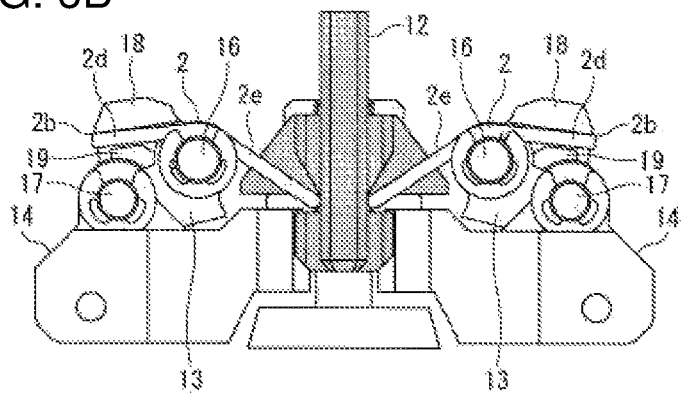
Figure 6C:
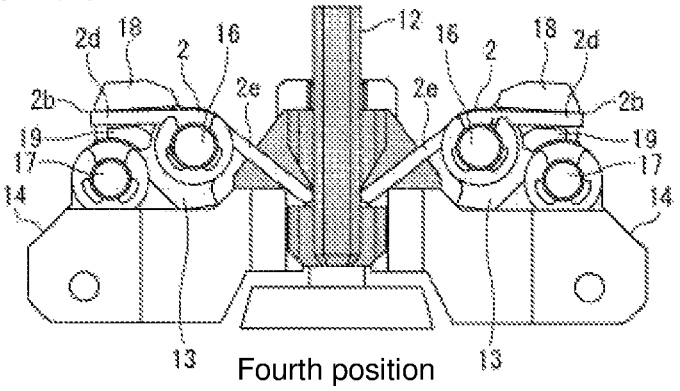

FIGS. 6A to 6C are front views of the actuation unit 12 for describing its movement. FIG. 6A shows the initial state of movement. FIG. 6B shows the intermediate state of movement. FIG. 6C shows the state of completed movement.

In the initial state (FIG. 6A), the actuation unit 12 is at the third position. When the operation unit 11 reaches the stroke S2, the actuation unit 12 starts moving downward. FIG. 6B shows the actuation unit 12 that is moving. As the actuation unit 12 moves, the connecting arms 2*e* are depressed while receiving a torque. This deflects (elastically deforms) the second springs 2. This movement changes the angle between the connecting arm 2*e* and the arms 2*d*, and also causes the second spring 2 and the movable unit 13 to rotate about the shaft 17. FIG. 6C shows the state of the completely moved actuation unit 12, or the actuation unit 12 at the fourth position.

As the actuation unit 12 moves downward, the axes of the second springs 2 (the positions of the shafts 16) move downward. This also changes the angle of each arm 2*d* fixed to each movable unit 13 in the same direction of rotation as the angle of the connecting arm 2*e*. The connecting arm 2*e* has its top end in contact with the side surface of the actuation unit 12, and can be displaced in accordance with the movement of the actuation unit 12. This extends the stroke of the actuation unit 12 in one or more embodiments, as compared with the structure in which the axes of the second springs 2 and the positions of the arms 2*d* are fixed.

Figure 7:
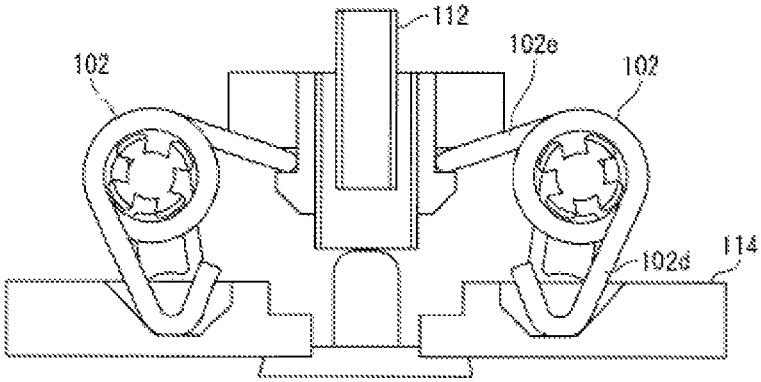
FIG. 7 is a front view of an actuation unit according to a reference example illustrating its structure.

FIG. 7 is a front view of an actuation unit 112 according to a reference example showing its structure. Torsion coil springs 102 are arranged on both sides of the actuation unit 112. Each torsion coil spring 102 includes a connecting arm 102*e* engaged in the recess in the actuation unit 112, and the other arm 102*d* engaged in the recess in a base 114. The base 114 is fixed. Each torsion coil spring 102 includes a coil portion (axis) fixed to the base 114. When the actuation unit 112 moves downward in this reference example, only the connecting arms 102*e* of the torsion coil springs 102 are displaced. As the actuation unit 112 is displaced, the distance between the pivot of each connecting arm 102*e* (the position at which the coil is connected) and the corresponding recess in the actuation unit 112 changes. The structure of the reference example thus cannot extend the stroke of the actuation unit 112. Forcibly extending the stroke of the actuation unit 112 in this structure can greatly deform the torsion coil springs 102, and shorten the lifetime of the torsion coil springs 102. To extend the stroke of the actuation unit 112 while extending the lifetime, longer connecting arms 102*e* are to be used to place the axes of the torsion coil springs 102 more away from the actuation unit 112. However, the use of larger torsion coil springs 102 can increase the size of the switch device. When the coil portion (axis) of each torsion coil spring 102 is not fixed and is freely movable, the arms 102*d* can change their orientations (angles) as the actuation unit 112 is displaced. The recesses in the base 114 in contact with the arms 102*d* can wear. This can lower the durability.

In one or more embodiments, the movable units 13 are arranged between the actuation unit 12 and the first base 14. The second springs 2 that are torsion coil springs act between the actuation unit 12 and the movable units 13. The movable units 13 move as the actuation unit 12 is displaced. This structure can reduce the size of the switch device and extend the lifetime of the second springs 2, while extending the stroke of the actuation unit 12. The second springs 2 accelerate the actuation unit 12, and thus increase the amount of power generation.

The arms 2*d* of each second spring 2 are fixed between the support 18 and the position regulating ridge 19. The angle of each arm 2*d* with the movable unit 13 is fixed, causing no sliding between the arm 2*d* and the movable unit 13 when the actuation unit 12 is displaced. This prevents wear of the arms 2*d* and the movable units 13. The movable unit 13 increases the angle between the connecting arm 2*e* and each arm 2*d* (to near a straight line). A relatively large angle between the connecting arm 2*e* and each arm 2*d* eases the assembly.

The use of other springs (e.g., plate springs or compression coil springs) replacing the second springs 2 for achieving the long lifetime and the long stroke as in one or more embodiments may need large plate springs or compression coil springs. To reduce the size of the switch device, the torsion coil springs may be used as in one or more embodiments.

Another component may be arranged between each movable unit 13 and the first base 14. For example, another movable unit (second movable unit) may be arranged between each movable unit 13 and the first base 14. For example, each movable unit 13 rotates relative to the connected second movable unit, and the second movable unit rotates relative to the connected first base 14. Another torsion coil spring may be arranged between each movable unit 13 and the second movable unit. The other torsion coil spring may have its one arm fixed to each movable unit 13, and the other arm fixed to the second movable unit.

Structure of Power Generator

Figure 8:
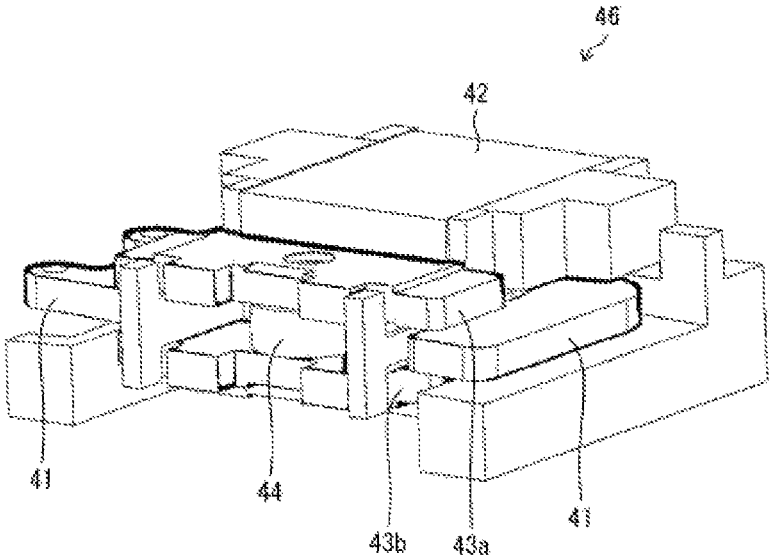
FIG. 8 is a perspective view of a power generator included in a switch device according to one or more embodiments.

FIG. 8 is a perspective view of a power generator 46 showing its structure.

The switch device according to one or more embodiments includes the return mechanism 50, the power generator 46, and a transmitter. The power generator 46 includes an armature 41, a coil 42, two yokes 43*a* and 43*b*, and a magnet 44. The armature 41 is connected to the actuation unit 12 with, for example, a plunger, and moves together with the actuation unit 12.

Figure 9A:
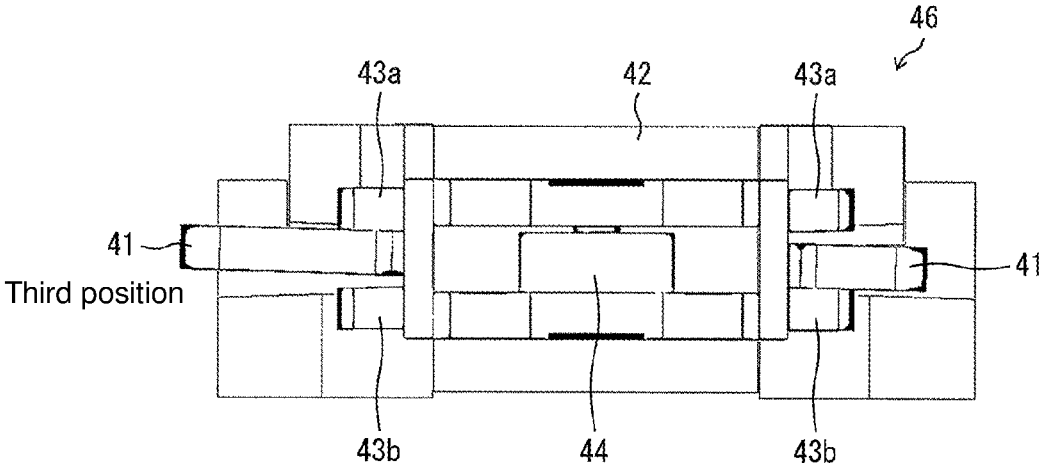
FIGS. 9A and 9B are front views of a power generator illustrating its structure.
Figure 9B:
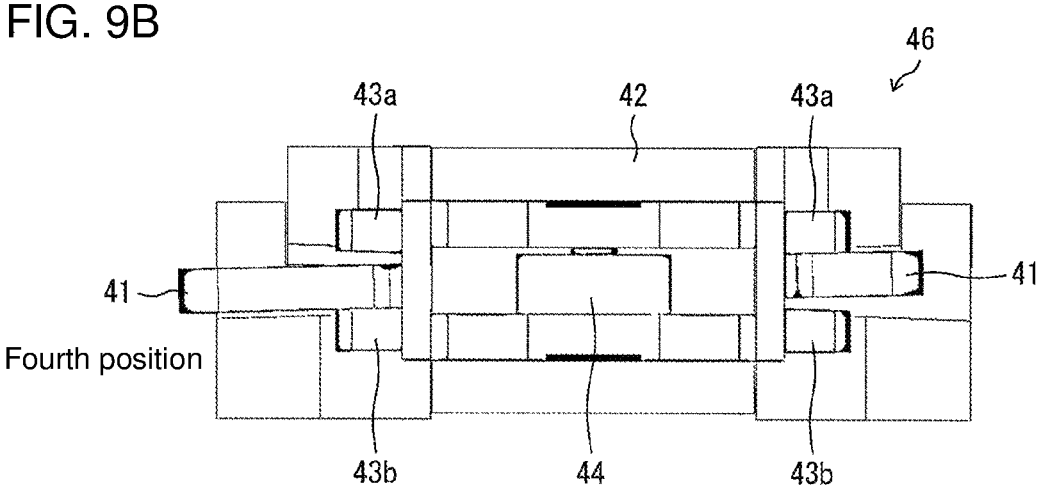

FIGS. 9A and 9B are front views of the power generator 46 showing its structure. FIG. 9A shows the power generator 46 when the actuation unit 12 is at the third position. FIG. 9B shows the power generator 46 when the actuation unit 12 at the fourth position.

The armature 41 is formed from a ferromagnetic material such as iron. The armature 41 is U-shaped. The armature 41 is rotatable about a pivot around the center (around the magnet 44) between the two yokes 43*a* and 43*b*. The armature 41 rotates between the two yokes 43*a* and 43*b* as the actuation unit 12 is displaced. The two yokes 43*a* and 43*b* are magnetized by the magnet 44 (permanent magnet) arranged between the yokes 43*a* and 43*b*. The armature 41 is placed through the coil 42.

When the actuation unit 12 is at the third position (the state shown in FIG. 9A), the armature 41 has its one end in contact with the yoke 43*a*, and has its other end in contact with the yoke 43*b*. The armature 41 is retained at this position (a position corresponding to the third position) under the magnetic force (retaining force) acting on these two ends. The actuation unit 12, which moves in cooperation with the armature 41, is also retained at the third position. The armature 41 can be a part of the actuation unit 12.

When the actuation unit 12 is at the fourth position (the state shown in FIG. 9B), the armature 41 has its one end in contact with the yoke 43*b*, and has its other end in contact with the yoke 43*a*. The armature 41 is retained at this position (a position corresponding to the fourth position) under the magnetic force (retaining force) acting on these two ends. The actuation unit 12, which moves in cooperation with the armature 41, is also retained at the fourth position.

The opposing faces of the two yokes 43*a* and 43*b* have opposite magnetic poles. When the actuation unit 12 moves from the third position to the fourth position, the magnetizing direction of the armature 41 is reversed. This reverses the direction of the magnetic flux passing through the coil 42, causing an inductive current to flow through the coil 42 in accordance with the variation in the magnetic flux. The power generator 46 generates power in this manner. A greater change in the magnetic flux per unit time causes a larger inductive current to flow. The return mechanism 50 in the switch device uses the first spring 1 and the second springs 2 to move the actuation unit 12 at high speed, and thus allows highly efficient power generation. The structure also extends the stroke of the actuation unit 12, and thus allows highly efficient power generation.

The coil 42 is connected to the transmitter (not shown) with, for example, lead wires. The transmitter uses power generated by the coil 42 to transmit signals to an external device either wirelessly or with wires. When the operation unit 11 is operated to move from the first position to the second position (or when the actuation unit 12 moves from the third position to the fourth position), the transmitter transmits, to the external device, a signal indicating that the operation unit 11 is at the second position (or the actuation unit 12 is at the fourth position). When the operation unit 11 returns from the second position to the first position (or when the actuation unit 12 returns from the fourth position to the third position), the transmitter transmits, to the external device, a signal indicating that the operation unit 11 is at the first position (or the actuation unit 12 is at the third position).

The switch device functions as a switch for transmitting a signal corresponding to the position of the operation unit 11 or the position of the actuation unit 12 to the external device. The switch device can be used as a switch, such as an operation switch operable by a user, or a limit switch (detection switch) for detecting the position of an object.

The transmitter may transmit a predetermined signal using generated power independently of the position of the operation unit 11 or the actuation unit 12. The power generator 46 and the return mechanism 50 may simply be used as a power generator.

The switch device may include a battery or an external power supply, instead of the power generator 46. In this case, the transmitter generates a signal corresponding to the position of the actuation unit 12 using power supplied from the battery or the external power supply.

The operation unit 11 may be directly operable by a user or an object for which its position is to be detected, or may be indirectly operated. For example, the rotational operation of a lever operated by a user may be converted into the movement of the operation unit 11.

Examples of Retaining Forces

Figure 10A:
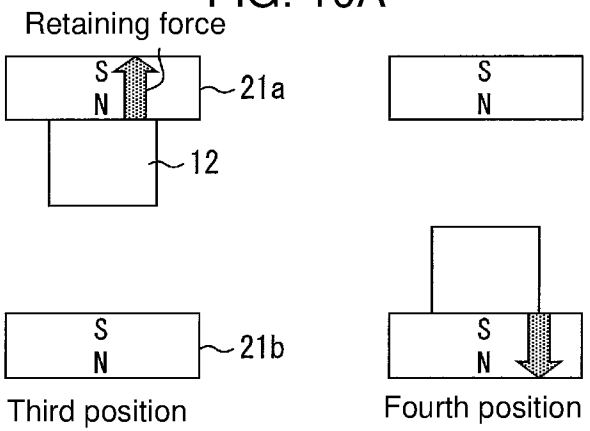
FIGS. 10A to 10D are diagrams illustrating retaining forces in examples.

FIGS. 10A to 10D are diagrams describing retaining forces in examples. FIG. 10A shows a magnetic force used as a retaining force. In this example, a return mechanism includes two magnets 21*a* and 21*b* facing each other with an actuation unit 12 between them. The actuation unit 12 is formed from a ferromagnetic material. The actuation unit 12 at the third position is retained at the third position under a magnetic force of the upper magnet 21*a*. The actuation unit 12 at the fourth position is retained at the fourth position under a magnetic force of the lower magnet 21*b*. The two magnets 21*a* and 21*b* may be joined to each other at a position not shown in the figure.

Figure 10B:
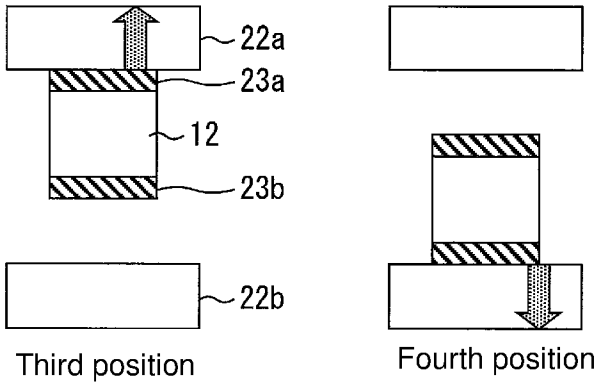

FIG. 10B shows an adhesive force used as a retaining force. In this example, a return mechanism includes two supports 22*a* and 22*b* facing each other with an actuation unit 12 between them. The actuation unit 12 includes adhesive members 23*a* and 23*b* on its upper and lower surfaces. The adhesive members 23*a* and 23*b* are adhered to supports 22*a* and 22*b* to retain the actuation unit 12 at the third position and the fourth position. The adhesive members 23*a* and 23*b* may be arranged on the opposing surfaces of the two supports 22*a* and 22*b*.

Figure 10C:
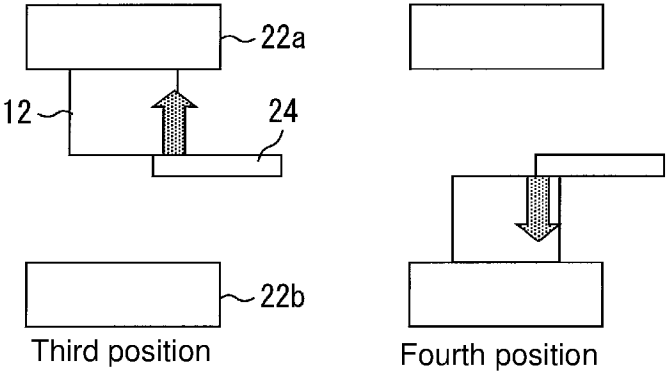

FIG. 10C shows a snap fit used as a holding mechanism. In this example, a return mechanism includes two supports 22*a* and 22*b* facing each other with an actuation unit 12 between them. The return mechanism includes an elastic body 24 that presses the actuation unit 12 against the third position or the fourth position. As the actuation unit 12 moves, the elastic body 24 deforms elastically.

Figure 10D:
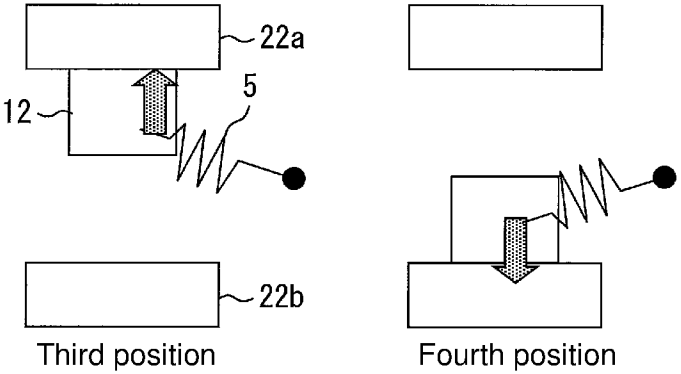

FIG. 10D shows a spring force used as a retaining force. In this example, a return mechanism includes two supports 22*a* and 22*b* facing each other with an actuation unit 12 between them, and a fifth spring 5. The fifth spring 5 has its one end fixed to another member, and its other end connected to the actuation unit 12. When the actuation unit 12 is at the third position, the fifth spring 5 is compressed to apply a restoring force acting upward. When the actuation unit 12 is at the fourth position, the fifth spring 5 is compressed to apply a restoring force acting downward. The second spring 2 may replace the fifth spring 5.

The retaining force may act on the actuation unit 12 at one of the third position and the fourth position, and may not act on the actuation unit 12 at the other position. For example, when the retaining force only acts on the actuation unit 12 at the third position, the actuation unit 12 moves at high speed with the first spring 1 during operation, whereas the actuation unit 12 returns at a speed corresponding to the speed of the operation unit 11 during returning. When the retaining force only acts on the actuation unit 12 at the fourth position, the actuation unit 12 moves at a speed corresponding to the speed of the operation unit 11 during operation, whereas the actuation unit 12 returns at high speed with the first spring 1 during returning. No retaining force may act on the actuation unit at both the third position and the fourth position. In this case as well, the actuation unit 12 can be accelerated by the varying component of the force of the second spring 2 along the stroke axis S as the actuation unit 12 moves. The operation unit 11 and the first spring 1 may be eliminated, and a user may operate the actuation unit 12.

Second Embodiment

Another embodiment will now be described. A switch device according to a second embodiment differs from the switch device according to a first embodiment in a fourth spring for returning movement, which replaces the third spring.

Structure of Return Mechanism 51

FIGS. 11A to 11H are schematic diagrams showing the operation and the returning of a return mechanism 51 included in the switch device according to one or more embodiments. A fourth spring 4 allows an operation unit 11 and an actuation unit 12 to self-return.

The return mechanism 51 (acceleration mechanism) includes the operation unit 11, the actuation unit 12, a movable unit 13, a first base 14 (not shown), a second base 15, a first spring 1, a second spring 2, and the fourth spring 4. The fourth spring 4 connects the operation unit 11 and the second base 15. The fourth spring 4 applies a force to the operation unit 11 in a direction parallel to a direction in which the operation unit 11 is movable.

As in a first embodiment, the operation unit 11 is displaced between a first position and a second position in accordance with an operational force, and the actuation unit 12 is displaced between a third position and a fourth position. In one or more embodiments, when the actuation unit 12 returns, the fourth spring 4 causes the operation unit 11 to return from the second position to the first position.

The stretched first spring 1 pulls the actuation unit 12 to cause the actuation unit 12 to return from the fourth position to the third position.

The second spring 2 (torsion coil spring) has a force acting obliquely to the direction in which the actuation unit 12 is movable. The restoring force of the second spring 2 acting on the actuation unit 12 includes a force component along a stroke axis S (force component having a direction in which the actuation unit 12 returns defined as positive) that is smaller when the actuation unit 12 is at the fourth position than when the actuation unit 12 is at the third position, showing a monotonic decrease. When the actuation unit 12 starts moving from the third position toward the fourth position, the repulsive force of the second spring 2 decreases gradually. The actuation unit 12 starts moving, and then accelerates further. During returning as well, the actuation unit 12 starts moving from the fourth position to the third position, and then accelerates under an increasing force component of the second spring 2 along the stroke axis S.

Figures 11A, 11B, 11C, 11D, 11E, 11F, 11G, 11H:
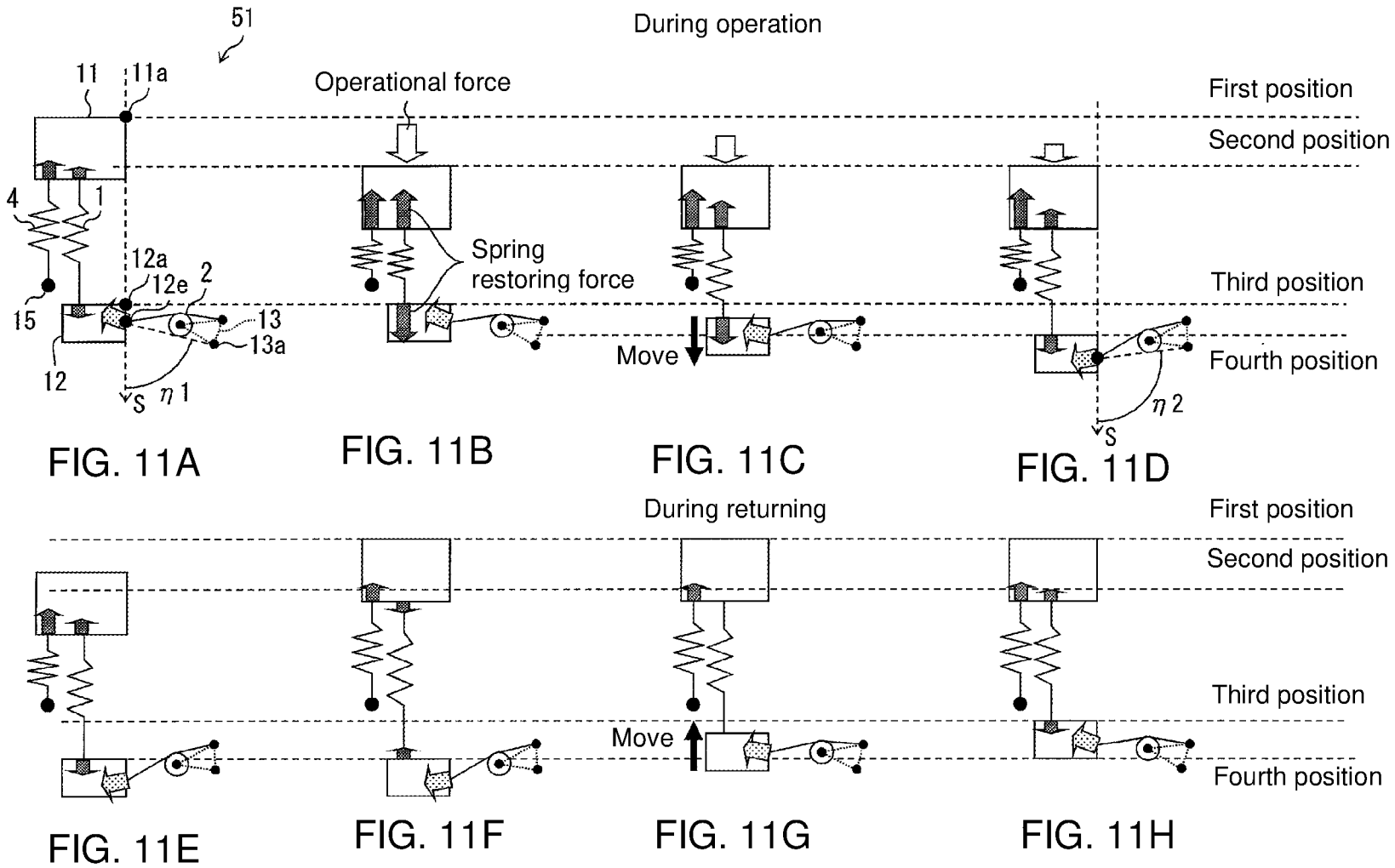
FIGS. 11A to 11H are schematic diagrams illustrating the operation and the returning of a return mechanism included in a switch device according to one or more embodiments.

FIG. 11A shows the initial state of the return mechanism 51. In the figures, spring forces acting on the operation unit 11 and the actuation unit 12 are indicated by arrows, each with the length not exactly showing the magnitude of the force. In the initial state, no external force is applied to the operation unit 11. In the initial state, the actuation unit 12 is retained at the third position under a restoring force (repulsive force) of the deformed second spring 2, and the retaining force (not shown). In the initial state, the operation unit 11 is pressed against the first position under a restoring force of the compressed first spring 1 and a restoring force of the compressed fourth spring 4.

FIG. 11B shows the operation unit 11 displaced under a force applied for operating the operation unit 11 (operational force). The operational force applied as an external force to the operation unit 11 displaces the operation unit 11 from the first position to the second position. The first spring 1 is compressed as the operation unit 11 is displaced.

When the restoring force of the compressed first spring 1 exceeds the sum of the restoring force of the second spring 2 and the retaining force, which act on the actuation unit 12, the restoring force of the compressed first spring 1 displaces the actuation unit 12 from the third position to the fourth position (FIG. 11C). The actuation unit 12 displaced to the fourth position is retained at the fourth position under the retaining force (FIG. 11D). As the joint 12*b* on the actuation unit 12 is displaced, the second spring 2 changes its orientation (the second spring 2 rotates) to change the direction of its restoring force.

The restoring force of the second spring 2 acting on the actuation unit 12 includes a force component along the stroke axis S (force component having a direction in which the actuation unit 12 returns defined as positive) that is smaller when the actuation unit 12 is at the fourth position than when the actuation unit 12 is at the third position, showing a monotonic decrease. When the actuation unit 12 starts moving from the third position toward the fourth position, the repulsive force of the second spring 2 decreases gradually. The actuation unit 12 starts moving, and then accelerates further. This completes the movement of the operation unit 11 and the actuation unit 12 during operation.

When the operational force on the operation unit 11 is eliminated, the operation unit 11 starts moving from the second position to the first position under the restoring force of the compressed fourth spring 4 (FIG. 11E). In this state, the actuation unit 12 is retained at the fourth position under the retaining force and the restoring force of the first spring 1.

When the operation unit 11 returns to the first position, the first spring 1 stretches longer than its equilibrium length (FIG. 11F). The restoring force of the stretched first spring 1 acts in a direction to pull the actuation unit 12 upward. When the restoring force of the stretched first spring 1 exceeds the sum of the component of the restoring force of the second spring 2 acting on the actuation unit 12 along the stroke axis S and the retaining force, the restoring force of the stretched first spring 1 displaces the actuation unit 12 from the fourth position to the third position (FIG. 11G). Although the first spring 1 is compressed while the actuation unit 12 is returning, the component of the restoring force of the second spring 2 along the stroke axis S acts upward on the actuation unit 12. The operation unit 11 thus returns to the third position (FIG. 11H). This completes the movement of the operation unit 11 and the actuation unit 12 during returning.

The actuation unit 12 is moved by the first spring 1 when the elastic energy accumulated in the first spring 1 is released. In other words, the actuation unit 12 is moved by the first spring 1 at high speed independently of the returning speed of the operation unit 11.

The operation unit 11 in each of the return mechanisms 50 and 51 may rotate. As the operation unit 11 rotates, the first spring 1 connected at an operation point of the operation unit 11 is either compressed or stretched.

SUMMARY

A switch device according to one or more aspects is switchable in accordance with a position of an actuation unit. The switch device includes the actuation unit, a movable unit, a base, and a torsion coil spring that acts between the actuation unit and the movable unit. The movable unit is movable with respect to the base supporting the movable unit. The actuation unit is movable between a first actuation position and a second actuation position. When the actuation unit is at the first actuation position, the torsion coil spring applies a force to the actuation unit in a direction that is not parallel to a direction in which the torsion coil spring applies a force to the actuation unit when the actuation unit is at the second actuation position.

In the above structure, the direction in which the torsion coil spring applies a force to the actuation unit changes in accordance with the position of the actuation unit (actuation position). The movable unit can move in accordance with the movement of the actuation unit (in accordance with the direction of the force of the torsion coil spring). The torsion coil spring can have less deflection as the actuation unit moves. This can extend the stroke of the actuation unit. The torsion coil spring with less deflection can be smaller. This can reduce the size of the switch device, and can also extend the stroke of the actuation unit.

The torsion coil spring may have an arm fixed to the movable unit.

In the above structure, the torsion coil spring and the movable unit move together as the actuation unit moves. The torsion coil spring can thus have less deflection as the actuation unit moves. This allows a longer stroke to be set for the actuation unit.

The movable unit may include a position regulating ridge, and a support that receives a force from the arm of the torsion coil spring. The arm of the torsion coil spring may be between the support and the position regulating ridge.

In the above structure, the arm of the torsion coil spring is between the support and the position regulating ridge and is thus prevented from being removed under impact. This structure also prevents the arm from being removed from the movable unit during the assembly of the switch device, and thus improves the workability in the assembly.

The movable unit may be rotatable with respect to the base in accordance with movement of the actuation unit.

In the above structure, the movable unit rotates in accordance with the movement of the actuation unit. The torsion coil spring can thus have less deflection as the actuation unit moves.

The movable unit may be fixed to the base in a rotatable manner with a shaft placed through the movable unit and the base.

In the above structure, the shaft is placed through the movable unit and the base to prevent the movable unit from being removed from the base under, for example, impact.

The torsion coil spring may have an axis portion fixed to the movable unit. The torsion coil spring may have an axis portion fixed to the movable unit with a shaft placed through a coil portion of the torsion coil spring.

In the above structure, the axis portion of the torsion coil spring is fixed to the movable unit. This structure prevents the axis portion of the torsion coil spring from being twisted (changing the axis orientation). The torsion coil spring can thus apply a force to the actuation unit in a stable manner.

The torsion coil spring may include two coil portions that are coaxial, a connecting arm connecting the two coil portions, and two arms extending from the respective two coil portions.

In the above structure, the connecting arm can be supported by the two coil portions. This stabilizes the direction in which the connecting arm applies a force to the actuation unit.

The torsion coil spring may apply a force including, in a moving direction of the actuation unit, a force component that is smaller when the actuation unit is at the second actuation position than when the actuation unit is at the first actuation position. The force component has a direction in which the actuation unit returns from the second actuation position to the first actuation position defined as positive.

In the above structure, the component of the force of the torsion coil spring in the direction in which the actuation unit moves is smaller when the actuation unit is at the second actuation position than when the actuation unit is at first actuation position. The actuation unit starts moving and then can accelerate further.

The switch device may include an operation unit, and an acceleration spring that acts between the operation unit and the actuation unit. The operation unit may move under an external force from a first operation position to a second operation position. The actuation unit may move between the first actuation position and the second actuation position in accordance with movement of the operation unit between the first operation position and the second operation position. The acceleration spring may move the actuation unit with elastic energy accumulated under an external force applied to the operation unit. When the actuation unit is at the first actuation position and/or the second actuation position, the actuation unit may receive a retaining force for retaining the actuation unit at the first actuation position and/or the second actuation position.

In the above structure, when the retaining force acts on the actuation unit at the first actuation position, for example, elastic energy accumulates in the acceleration spring as the operation unit moves from the first operation position to the second operation position. When the effect of the restoring force of the acceleration spring exceeds the sum of the component of the restoring force of the torsion coil spring in the movement direction and the retaining force, the elastic energy accumulated in the acceleration spring is released, and thus the actuation unit can move at high speed independently of the operation speed. In the same manner, when the retaining force acts on the actuation unit at the fourth position, the actuation unit can return at high speed.

The switch device may include a magnet, and a coil that induces a current by varying a magnetic flux of the magnet passing through the coil in accordance with movement of the actuation unit.

In the above structure, the actuation unit can move to generate power.

The embodiments disclosed above should not be construed to be restrictive, but may be modified within the spirit and scope of the claimed invention. The technical features disclosed in different embodiments may be combined in other embodiments within the technical scope of the invention.

INDUSTRIAL APPLICABILITY

One or more aspects are applicable to switch devices.

REFERENCE SIGNS LIST

1 first spring (acceleration spring)
2 second spring (torsion coil spring)
2*c* coil portion
2*d* arm
2*e* connecting arm
3 third spring
4 fourth spring
5 fifth spring
11 operation unit
12 actuation unit
13 movable unit
14 first base (base)
15 second base
16, 17 shaft
18 support
19 position regulating ridge
21*a*, 21*b*, 44 magnet
41 armature
42 coil
43*a*, 43*b* yoke
46 power generator
50, 51 return mechanism

The invention claimed is:

1. A switch device that is switchable in accordance with a position of an actuation unit, the switch device comprising:

the actuation unit;

a movable unit;

a base;

a torsion coil spring that acts between the actuation unit and the movable unit;

an operation unit; and an acceleration spring that acts between the operation unit and the actuation unit, wherein the movable unit is movable with respect to the base supporting the movable unit, the actuation unit is movable between a first actuation position and a second actuation position, when the actuation unit is at the first actuation position, the torsion coil spring applies a force to the actuation unit in a direction that is not parallel to a direction in which the torsion coil spring applies a force to the actuation unit when the actuation unit is at the second actuation position, the operation unit moves under an external force from a first operation position to a second operation position, the actuation unit moves between the first actuation position and the second actuation position in accordance with movement of the operation unit between the first operation position and the second operation position, and the acceleration spring moves the actuation unit with elastic energy accumulated under an external force applied to the operation unit.

2. The switch device according to claim 1, wherein the torsion coil spring has an arm fixed to the movable unit.

3. The switch device according to claim 2, wherein the movable unit includes a position regulating ridge, and a support configured to receive a force from the arm of the torsion coil spring, and the arm of the torsion coil spring is between the support and the position regulating ridge.

4. The switch device according to claim 2, wherein the movable unit is rotatable with respect to the base in accordance with movement of the actuation unit.

5. The switch device according to claim 3, wherein the movable unit is rotatable with respect to the base in accordance with movement of the actuation unit.

6. The switch device according to claim 1, wherein the movable unit is rotatable with respect to the base in accordance with movement of the actuation unit.

7. The switch device according to claim 6, wherein the movable unit is fixed to the base in a rotatable manner with a shaft placed through the movable unit and the base.

8. The switch device according to claim 1, wherein the torsion coil spring has an axis portion fixed to the movable unit.

9. The switch device according to claim 8, wherein the torsion coil spring has the axis portion fixed to the movable unit with a shaft placed through a coil portion of the torsion coil spring.

10. The switch device according to claim 1, wherein the torsion coil spring includes two coil portions that are coaxial, a connecting arm connecting the two coil portions, and two arms extending from the respective two coil portions.

11. The switch device according to claim 1, wherein the torsion coil spring applies a force including, in a moving direction of the actuation unit, a force component that is smaller when the actuation unit is at the second actuation position than when the actuation unit is at the first actuation position, and the force component has a direction in which the actuation unit returns from the second actuation position to the first actuation position defined as positive.

12. The switch device according to claim 1, wherein when the actuation unit is at the first actuation position and/or the second actuation position, the actuation unit receives a retaining force for retaining the actuation unit at the first actuation position and/or the second actuation position.

13. The switch device according to claim 1, further comprising:

a magnet; and a coil configured to induce a current by varying a magnetic flux of the magnet passing through the coil in accordance with movement of the actuation unit.

* * * * *